United States Patent [19]

Speers

[11] Patent Number: 4,911,287

[45] Date of Patent: Mar. 27, 1990

[54] EARRING DISPLAY PACKAGE

[75] Inventor: Samuel F. Speers, Sarasota, Fla.

[73] Assignee: Design Data, Inc., East Greenwich, R.I.

[21] Appl. No.: 326,526

[22] Filed: Mar. 20, 1989

[51] Int. Cl.[4] ..... B65D 73/00; A44B 7/00

[52] U.S. Cl. ..... 206/45.14; 63/19.1; 206/348; 206/457; 206/459; 206/575; 211/13; 273/269; 283/56

[58] Field of Search ..... 206/44 R, 44.11, 44.12, 206/45.14, 216, 223, 575, 348, 457–458, 486, 488, 490, 495, 806; 40/159, 301, 302, 639, 650; 63/12, 13, 14.1–14.8, 18; D11/41, 61, 116, 79; 211/13; D9/341, 345, 457, 456; 283/56; 273/269

[56] References Cited

U.S. PATENT DOCUMENTS

| | | | |
|---|---|---|---|
| D. 269,766 | 7/1983 | Strasser et al. | D9/457 |
| 1,460,492 | 7/1923 | Latz | 283/56 |
| 1,469,081 | 9/1923 | Goldman | 206/458 |
| 2,302,045 | 11/1942 | Neumann et al. | 206/348 X |
| 2,433,711 | 12/1947 | Schober et al. | 63/14.6 |
| 2,807,362 | 9/1957 | Haddad | 206/495 |
| 2,914,871 | 12/1959 | Smith et al. | 206/44.12 |
| 3,618,952 | 11/1971 | Tallarida | 273/269 |
| 3,678,705 | 7/1972 | Korwin | 40/639 X |
| 4,019,744 | 4/1977 | Pizur, Sr. | 273/269 |
| 4,378,884 | 4/1983 | Anderson | 206/459 |
| 4,391,375 | 7/1983 | Joyce | 211/13 |
| 4,534,185 | 8/1985 | Berry et al. | 63/13 X |
| 4,575,125 | 3/1986 | Augier | 206/459 X |
| 4,696,706 | 9/1987 | Griffin et al. | 40/360 X |
| 4,739,878 | 4/1988 | DiDomenico | 206/45.14 |

OTHER PUBLICATIONS

National Jeweler Magazine, May 1975, p. 9, advertisement.

*Primary Examiner*—Bryon P. Gehman

*Attorney, Agent, or Firm*—Salter & Michaelson

[57] ABSTRACT

An earring package comprising a flexible sheet having a plurality of connected but readily detachable ornamental portions, said ornamental portions aesthetically differing from each other except that there are identical pairs of each different design, said sheet further having a mounting portion to which a pair of earring findings are releaseably connected, whereby a person may detach a pair of identical ornamental portions from said sheet, and after separating the earring findings from their mounting, may assemble an ornamental portion to each finding to provide a pair of finished earrings.

3 Claims, 1 Drawing Sheet

EARRING DISPLAY PACKAGE

BACKGROUND AND SUMMARY OF THE INVENTION

The present invention relates generally to the jewelry art, and is specifically concerned with the provision of a novel and improved earring package wherein a plurality of ornamental portions are presented in sheet form whereby the user may select, detach and assemble the desired ornaments to earring findings in order to provide a pair of finished earrings.

Although it is broadly not new to provide an earring package wherein a plurality of ornaments are presented so that the user may seletively utilize the particular ornaments she wants to use to achieve the desired look, such ornaments are usually three dimensional in nature and are presented in the package as separate items. While this has perhaps been satisfactory in providing the purchaser with the desired selectability, specific packaging has to be provided for packaging the plurality of separate ornaments, and the method of securing the separate ornaments to the earring findings normally requires some specialized structure, such as a magnet, snap-fasteners etc., thus increasing the cost to the consumer of such a package.

The present invention, on the other hand, involves ornaments that are basically two dimensional in nature and that are presented in sheet form with the separate ornaments therein being readily detachable from the sheet and being readily assembleable to the earring findings. Thus, an earring package is provided that is extremely simple and inexpensive to manufacture, and is extremely easy to use insofar as assembly of the finished earrings is concerned.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

There is shown generally at 10 an earring package constructed in accordance with the present invention. The package 10 comprises a sheet 12 of flexible but relatively firm material, preferably a plastic material such as vinyl, polyethylene or polystyrene. The sheet 12 comprises a plurality of connected but readily detachable, ornamental portions 14 each of which has ornamentation thereon in the nature of indicia which may take the form of catchy slogans or words, or which may involve other forms of artistic expression, such as floral designs or the like, as illustrated at the portions specifically identified as 14*a*. Although the material of which the sheet 12 is constructed is not critical, it is important that whatever material be used be capable of accepting printing thereon so that the indicia or art work that is applied to the portions 14 may be applied by conventional printing techniques. Although the sheet 12 is basically two-dimensional in nature, it is contemplated tha the design applied thereto may involve an embossing technique, so as to provide a three-dimensional perception thereto.

Figure 1:
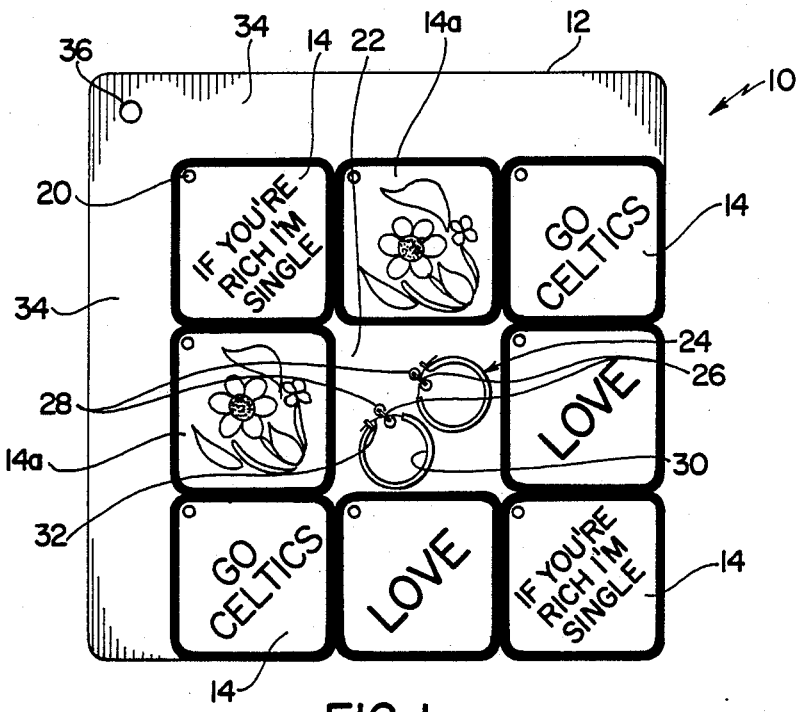
FIG. 1 is a plan view of an earring package constructed in accordance with this invention.

In the sheet 12 illustrated in FIG. 1, it will be noted that eight ornamental portions are shown, although the precise number is not critical except that in order to have the desired selectability, it is desirable that at least four ornamental portions be provided. Since it is desirable that each pair of earrings have identical ornamentation on each earring, the different designs or indicia provided on the ornamental portions 14 are provided in pairs, i.e., each ornamental portion 14 has an identical counterpart in the sheet 12. Obviously this does not preclude the possibility that different ornamentation may be worn on each ear, if desired, in which case it would be possible for the package 10 to comprise eight different ornamental portions 14.

Figure 2:
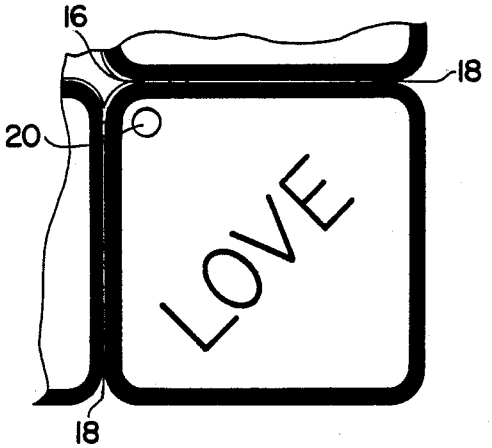
FIG. 2 is a fragmentary plan view, on an enlarged scale, of one of the ornamental portions that form a part of this invention.

In order to permit ready detachment of the ornamental portion 14 from sheet 12, each ornamental portion is preferably severed from adjacent portions or areas, such as by die cutting, as illustrated at 16 in FIG. 2. In order to provide the desired releasable attachment of each ornamental portion to the sheet, there are provided small unsevered portions 18 which may be easily torn or broken when it is desired to detach the ornamental portion from the sheet. Other suitable detachable connection means could be utilized if desired, such as providing score lines (not shown) around each ornamental portion so as to permit the latter to be broken away and detached when desired. As will be noted, each ornamental portion is provided with a small aperture 20 adjacent one of the the edges thereof, and preferably adjacent one of the corners where the ornamental portions are of square or rectangular configuration. In this connection it should be noted that the shape of the ornamental portion is not critical and, in fact, the design feature of each ornamental portion could be the shape thereof, i.e., the configuration of the periphery of the ornamental portion could assume animal shapes or the like. Once again, however, each ornamental portion should have an identical counterpart in the sheet so that there will be a pair of ornamental portions embodying each design for assembly to the earrings.

As will be seen in FIG. 1, the sheet 12 also includes a mounting portion 22 on which a pair of earring findings 24 are releasably mounted or attached, such as by wire binders 26 that extend through openings 28 and then are either knotted or twisted on the reverse side of sheet 12. The earring findings 24 are conventional in nature and may include a pierced earring having a hoop portion 30 and a piercing wire 32. In the sheet 12 illustrated in FIG. 1, it will be seen that the mounting portion 22 is centrally located with respect to the ornamental portions 14, although this is certainaly not necessary or critical. In addition, the sheet 12 comprises marginal portions 34, which likewise are not essential, but which provide a space for printing advertising indicia relating to the package 10. As will be seen in FIG. 1, an aperture 36 may be provided in marginal portion 34 to facilitate hanging of the package 10 on a point-of-sale rack or display.

Figure 3:
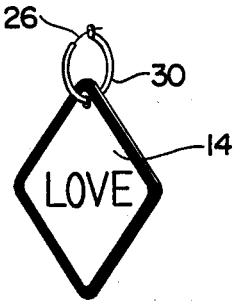
FIG. 3 is a perspective view of a finished earring assembly.

It will be understood that the package 10 is sold in the form illustrated in FIG. 1, and in use, the purchaser simply detaches the ornamental portions from the sheet, removes the earring findings 24 by untying the wire retainers 26, and then assembles whatever pair of ornamental portions she desires to use to the earring findings by threading hoop portions 30 through apertures 20 so that the ornamental portion suspends from the earring as clearly illustrated in FIG. 3. When it is desired to substitute a different pair of ornamental portions, it is simply necessary to slide the assembled portions 14 off of the hoops 30 and then mount another pair of ornamental portions in lieu thereof.

Although the ornamental portions are shown in abutting relation to each other on the sheet 12 in order to maximize material conservation, there could be strips of material between adjacent edges if desirable for any reason.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. An earring package comprising a flexible sheet having a plurality of connected, but readily detachable ornamental portions, an aperture in each ornamental portion adjacent an edge thereof, a mounting portion on said sheet, and a pair of earring findings releasably connected to said mounting portion, whereby a pair of ornamental portions may be detached from said sheet and mounted on said earring findings by threading a part of the latter through said apertures, thereby providing finished earrings having said ornamental portions suspended therefrom.

2. In the earring package of claim 1, at least some of said ornamental portions differing aesthetically from some of the others.

3. In the earring package of claim 1, said earring findings each comprising a hoop portion, said apertures being slightly larger than the cross sectional dimension of said hoop portions whereby the ornamental portions may be threaded on to said hoop portions so as to depend therefrom.

* * * * *